US007128054B2

(12) United States Patent
Koehler et al.

(10) Patent No.: US 7,128,054 B2
(45) Date of Patent: Oct. 31, 2006

(54) FUEL INJECTION SYSTEM FOR AN INTERNAL COMBUSTION ENGINE

(75) Inventors: Achim Koehler, Ditzingen (DE); Sascha Ambrock, Gerlingen (DE); Thomas Boehm, deceased, late of Leonberg (DE); by Petra Boehm, legal representative, Leonberg (DE); by Jacqueline Boehm, legal representative, Leonberg (DE); by Natalie Boehm, legal representative, Leonberg (DE)

(73) Assignee: Robert Bosch GmbH, Stuttgart (DE)

( * ) Notice: Subject to any disclaimer, the term of this patent is extended or adjusted under 35 U.S.C. 154(b) by 257 days.

(21) Appl. No.: 10/493,449

(22) PCT Filed: Feb. 11, 2003

(86) PCT No.: PCT/DE03/00382

§ 371 (c)(1),
(2), (4) Date: Apr. 23, 2004

(87) PCT Pub. No.: WO2004/020816

PCT Pub. Date: Mar. 11, 2004

(65) Prior Publication Data

US 2006/0016432 A1 Jan. 26, 2006

(30) Foreign Application Priority Data

Aug. 28, 2002 (DE) ..... 102 39 429

(51) Int. Cl.
*F02M 37/04* (2006.01)

(52) U.S. Cl. ..... 123/446; 123/510

(58) Field of Classification Search ..... 123/446, 123/447, 457, 458, 510, 511
See application file for complete search history.

(56) References Cited

U.S. PATENT DOCUMENTS

| | | | | |
|---|---|---|---|---|
| 4,643,155 | A * | 2/1987 | O'Neill | 123/506 |
| 4,884,545 | A * | 12/1989 | Mathis | 123/447 |
| 5,884,606 | A * | 3/1999 | Kellner et al. | 123/446 |
| 5,971,718 | A * | 10/1999 | Krueger et al. | 417/286 |
| 6,142,747 | A * | 11/2000 | Rosenau et al. | 417/251 |
| 6,253,734 | B1 * | 7/2001 | Rembold et al. | 123/446 |
| 6,976,473 | B1 * | 12/2005 | Boos et al. | 123/446 |
| 2004/0155120 | A1 * | 8/2004 | Boos et al. | 239/533.2 |

* cited by examiner

*Primary Examiner*—Thomas Moulis
(74) *Attorney, Agent, or Firm*—Ronald E. Greigg

(57) ABSTRACT

The fuel injection system has a high-pressure pump, by which fuel is pumped at high pressure into a reservoir. By means of a feed pump, fuel is pumped from a fuel tank to the high-pressure pump. By means of a fuel metering device, disposed between the feed pump and the high-pressure pump, the inflow of fuel to the high-pressure pump is adjusted. From the connection between the feed pump and the fuel metering device, a bypass connection leads away to a relief region. An inflow of fuel from the feed pump to the fuel metering device and/or to the bypass connection is effected through at least one conduit in a housing part, and in the at least one conduit, at least one fuel filter is disposed upstream of the fuel metering device and/or of the bypass connection.

13 Claims, 4 Drawing Sheets

FUEL INJECTION SYSTEM FOR AN INTERNAL COMBUSTION ENGINE

CROSS-REFERENCE TO RELATED APPLICATIONS

This application is a 35 USC 371 application of PCT/DE 03/00382 filed on Feb. 11, 2003.

BACKGROUND OF THE INVENTION

Field of the Invention

The invention is directed to an improved fuel injection system for an internal combustion engine and more particularly to such a system employing a high pressure pump which supplies fuel at high pressure to a reservoir.

One fuel injection system known from German Patent Disclosure DE 199 07 311 A1 has a high-pressure pump, by which fuel is pumped at high pressure in a reservoir. Fuel is pumped out of a fuel tank to the high-pressure pump by a feed pump. A fuel metering device is also provided, which is disposed between the feed pump and the high-pressure pump. The fuel metering device serves to adjust the inflow of fuel to the high-pressure pump and thus the quantity of fuel pumped into the reservoir by the high-pressure pump, as a function of engine operating parameters. From the connection between the feed pump and the fuel metering device, a bypass connection leads away to a relief region, which is controlled by a pressure valve. Between the fuel tank and the feed pump, there is a fuel filter, by which contaminants in the fuel aspirated from the fuel tank are filtered out, so that they cannot get into the fuel metering device, the high-pressure pump, or the bypass connection. If contaminants are present in the connection between the feed pump and the fuel metering device, the high-pressure pump, or the bypass connection, for instance in the form of chips or burrs created in production, then they are not filtered out and can cause great wear and failure of the fuel metering device, the high-pressure pump, or the pressure valve of the bypass connection.

SUMMARY OF THE INVENTION

The fuel injection system of the invention has the advantage over the prior art that by means of the fuel filter, contaminants can be kept purposefully away from the fuel metering device, the high-pressure pump, and/or the pressure valve of the bypass connection, even if these contaminants are already present in the housing part.

Other advantageous features and refinements of the fuel injection system of the invention are disclosed. For example, a simple embodiment of the fuel filter is disclosed, and in another embodiment contaminants are kept away from the fuel metering device and from the pressure valve with a single fuel filter which prevents contaminants from being able to reach the drive region of the high-pressure pump.

BRIEF DESCRIPTION OF THE DRAWINGS

Other features of the invention will be apparent from the description contained herein below, taken with the drawings, in which.

DESCRIPTION OF THE PREFERRED EMBODIMENTS

Figure 1:
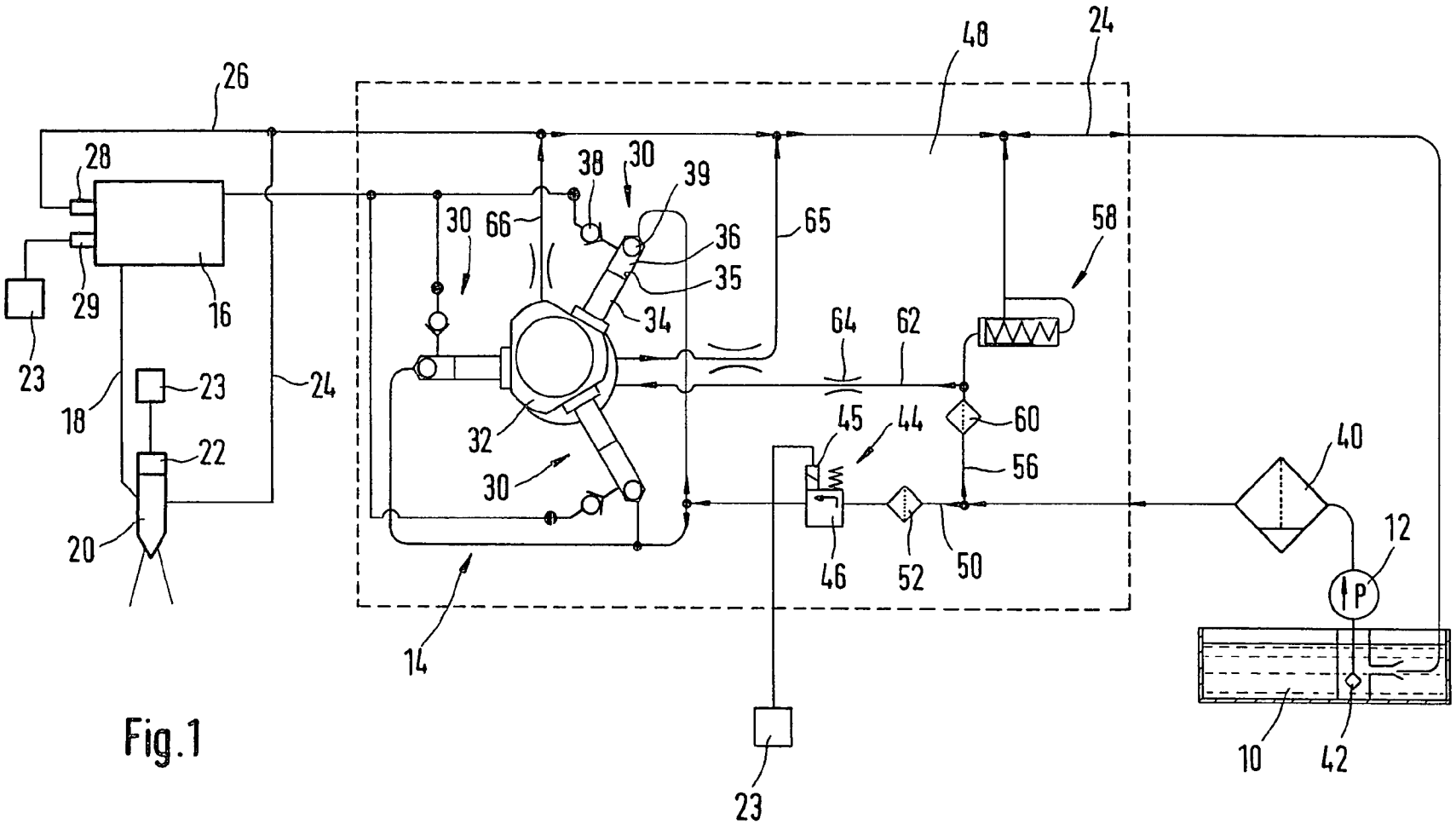
FIG. 1 shows a fuel injection system for an internal combustion engine schematically in a first exemplary embodiment.

In FIG. 1, a fuel injection system for an internal combustion engine, for instance of a motor vehicle, is schematically shown. The engine is preferably a self-igniting engine and has one or more cylinders. The motor vehicle has a fuel tank 10, in which fuel is held in readiness for engine operation. The fuel injection system has a feed pump 12, by which fuel is pumped out of the fuel tank 10 to a high-pressure pump 14. The high-pressure pump 14 pumps fuel into a reservoir 16, which can for instance be tubular or embodied in some arbitrary other shape. From the reservoir 16, lines 18 lead to injectors 20 disposed one at each of the cylinders of the engine. At each of the injectors 20 there is a respective electric control valve 22, by which an opening of the injectors is controlled in order to effect a fuel injection through the respective injector 20 or to prevent a fuel injection. The control valves 22 are triggered by an electronic control unit 23, by which the instant and duration of the fuel injection through the injectors 20 is determined as a function of engine operating parameters, such as rpm, load, temperature, and others. From the injectors 20, a return for unused fuel leads at least indirectly back into the fuel tank 10, for instance via a line 24 that is common to all the injectors. From the reservoir 16, a line 26 in which a pressure limiting valve 28 is disposed can also lead back to the fuel tank 10, in order to prevent an impermissibly high pressure from building up in the reservoir 16.

The high-pressure pump 14 is driven mechanically by the engine and thus in proportion to the engine rpm. The feed pump 12, in the exemplary embodiments shown in FIGS. 1 and 2, has an electric motor drive and is disposed separately from the high-pressure pump, for instance inside or outside the fuel tank 10.

The high-pressure pump 14 can be embodied as a radial piston pump and has a plurality of pump elements 30, for instance three, distributed at equal angular intervals from one another, each pump element 30 has a pump piston 34, which is driven by a polygon 32 in connection with an eccentric shaft in a reciprocating motion and is guided in a cylinder bore 35, and each pump piston defines one pump work chamber 36. In each of the connections of the pump work chambers 36 with the reservoir 16, there is a respective check valve, in the form of an outlet valve 38, which opens toward the reservoir 16 and by which the disconnection between the pump work chambers 36 and the reservoir 16 is effected in the intake stroke of the pump pistons 34. In each of the connections of the pump work chambers 36 with the feed pump 12, there is a check valve which opens toward the pump work chambers 36 and is in the form of an inlet valve 39, by which the disconnection between the pump work chambers 36 and the feed pump 12 is effected in the pumping stroke of the pump pistons 34. During each intake stroke of the pump pistons 34, when these pistons are moving radially inward, the pump work chambers 36, with the inlet valves 39 open, communicate with the outlet of the feed pump 12 and are filled with fuel; the pump work chambers 36 are disconnected from the reservoir 16 by the closed outlet valves 38. During each pumping stroke of the pump pistons 34, when these pistons are moving radially outward, the pump work chambers 36, with the outlet valves 38 open, communicate with the reservoir 16 and are disconnected from the outlet of the feed pump 12 by the closed inlet valves 39.

A fuel filter 40 is preferably disposed between the feed pump 12 and the high-pressure pump 14. A further fuel filter 42 can be disposed between the feed pump 12 and the fuel tank 10. The fuel filter 42 can for instance be embodied as a coarse filter and the fuel filter 40 as a fine filter; the fine filter 40 can additionally have a water separator.

A fuel metering device 44 is disposed between the feed pump 12 and the high-pressure pump 14. The fuel metering device 44 has a regulating valve 46, actuated by an electric actuator 45, such as an electromagnet or a piezoelectric actuator, and by means of this valve the flow from the feed pump 12 to the high-pressure pump 14 is continuously variable. The fuel metering device 44 is likewise triggered by the control unit 23, in such a way that by means of the feed pump 12, a quantity of fuel is delivered to the high-pressure pump 14 and then is pumped in turn by the high-pressure pump 14 at high pressure into the reservoir 16, in order to maintain a predetermined pressure in the reservoir 16 that is dependent on engine operating parameters. A pressure sensor 29 is provided, by which the pressure in the reservoir 16 is detected and which communicates with the control unit 23, so that the control unit is supplied with a signal for the actual pressure in the reservoir 16 and can trigger the fuel metering device 44 accordingly.

Figure 4:
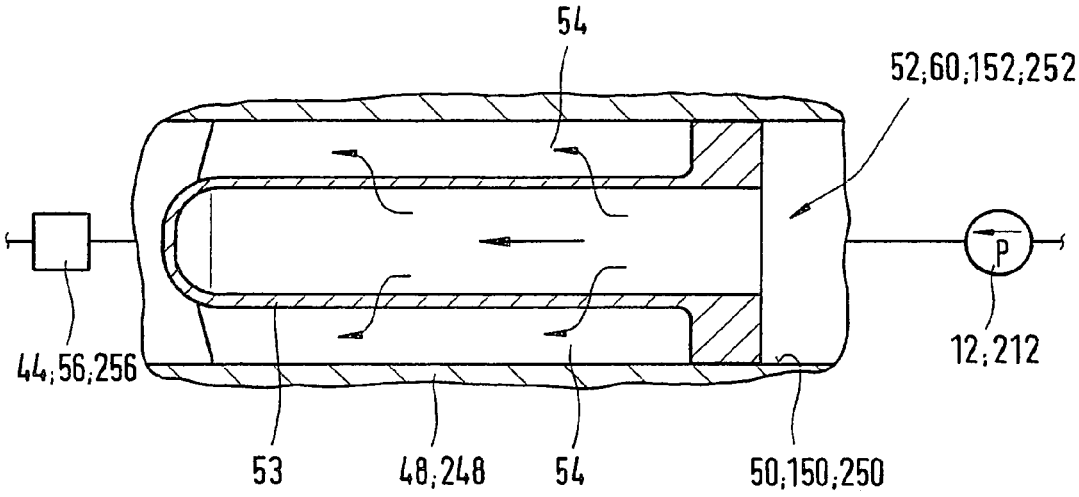
FIG. 4 shows a fuel filter of the fuel injection system in an enlarged view.

The fuel metering device 44 is disposed on a housing part 48, which is preferably a housing part such as a cap of the high-pressure pump 14. An inlet to the fuel metering device 44 from the feed pump 12 extends for instance in the form of at least one bore 50 through the housing part 48. Upstream of the fuel metering device 44, a further fuel filter 52 is inserted into the bore 50. The fuel filter 52 is for instance, as shown in FIG. 4, embodied as a rod filter, which is elongated in order to achieve a large surface area. The fuel filter 52 has a finger-shaped filter screen 53, which is closed on one end and open on the other, and a support body 54 with radial ribs, which is press-fitted into the bore 50, and a spacing exists between the filter screen 53 and the bore 50. The fuel from the feed pump 12 enters through the open end into the filter screen 53 and passes through the filter screen 53 in the circumferential direction and flows onward through the bore 50 to the fuel metering device 44. If contaminants, for instance in the form of burrs or metal chips, from the machining of the housing part 48 are present in the bore 50, they are trapped by the fuel filter 52, so that they cannot reach the fuel metering device 44 and impair its function. The filter screen 53 preferably has a mesh width of between about 20 μm and 500 μm.

From the bore 50, a bypass connection 56 can lead away, upstream of the fuel metering device 44, to a relief region; the return 24 to the fuel tank 10 can serve as this region. The bypass connection 56 is formed by a bore in the housing part 48. The bypass connection 56 is controlled by a pressure valve 58, which uncovers the bypass connection 56 if a predetermined pressure is exceeded. As a result, the pressure between the feed pump 12 and the fuel metering device 44 is limited, if either no fuel flow or only a slight fuel flow to the high-pressure pump 14 is set by the fuel metering device 44 yet the feed pump 12 is still pumping fuel. As represented by dashed lines in FIG. 1, a fuel filter 60 can be disposed in the bypass connection 56 upstream of the pressure valve 58. This fuel filter 60 can be provided alternatively or in addition to the fuel filter 52 upstream of the fuel metering device 44. By means of the fuel filter 60, contaminants that could otherwise impair the function of the pressure valve 58 are kept away from that valve.

As shown in FIG. 1, a lubrication connection 62, formed among other elements by the eccentric shaft and by the polygon 32, can branch off upstream of the pressure valve 58 and downstream of the fuel filter 60 to the drive region of the high-pressure pump 14. Via the lubrication connection 62, fuel is delivered to the drive region of the high-pressure pump 14 in order to lubricate and cool this region. A throttle restriction 64 is preferably disposed in the lubrication connection 62 in order to limit the flow through it. From the drive region of the high-pressure pump 14, connections 65, 66 lead away to the return 24, and through them fuel from the drive region of the high-pressure pump 14 can flow out; one throttle restriction may be disposed in each of the connections 65, 66. Thus by means of the fuel filter 60, contaminants are also kept away from the drive region of the high-pressure pump 14, where they could cause wear and damage.

Figure 2:
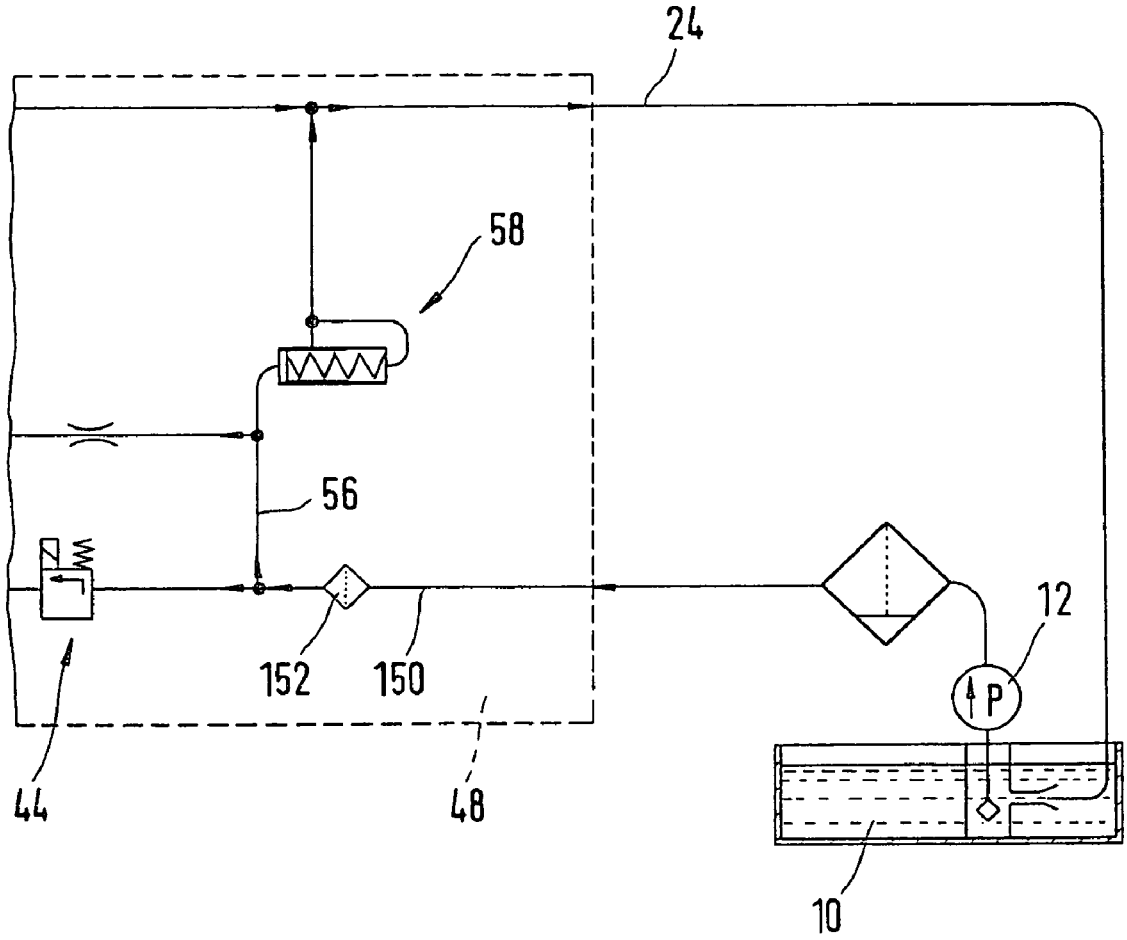
FIG. 2 shows a detail of the fuel injection system in a second exemplary embodiment.

In FIG. 2, the fuel injection system is shown in a second exemplary embodiment, which differs from the first exemplary embodiment in that only one fuel filter 152 is provided, which is inserted into the bore 50 upstream of the branching point of the bypass connection 56. With this disposition of the fuel filter 152, the fuel metering device 44, pressure valve 58 and drive region of the high-pressure pump 14 can all be protected against contaminants by a single fuel filter 152.

Figure 3:
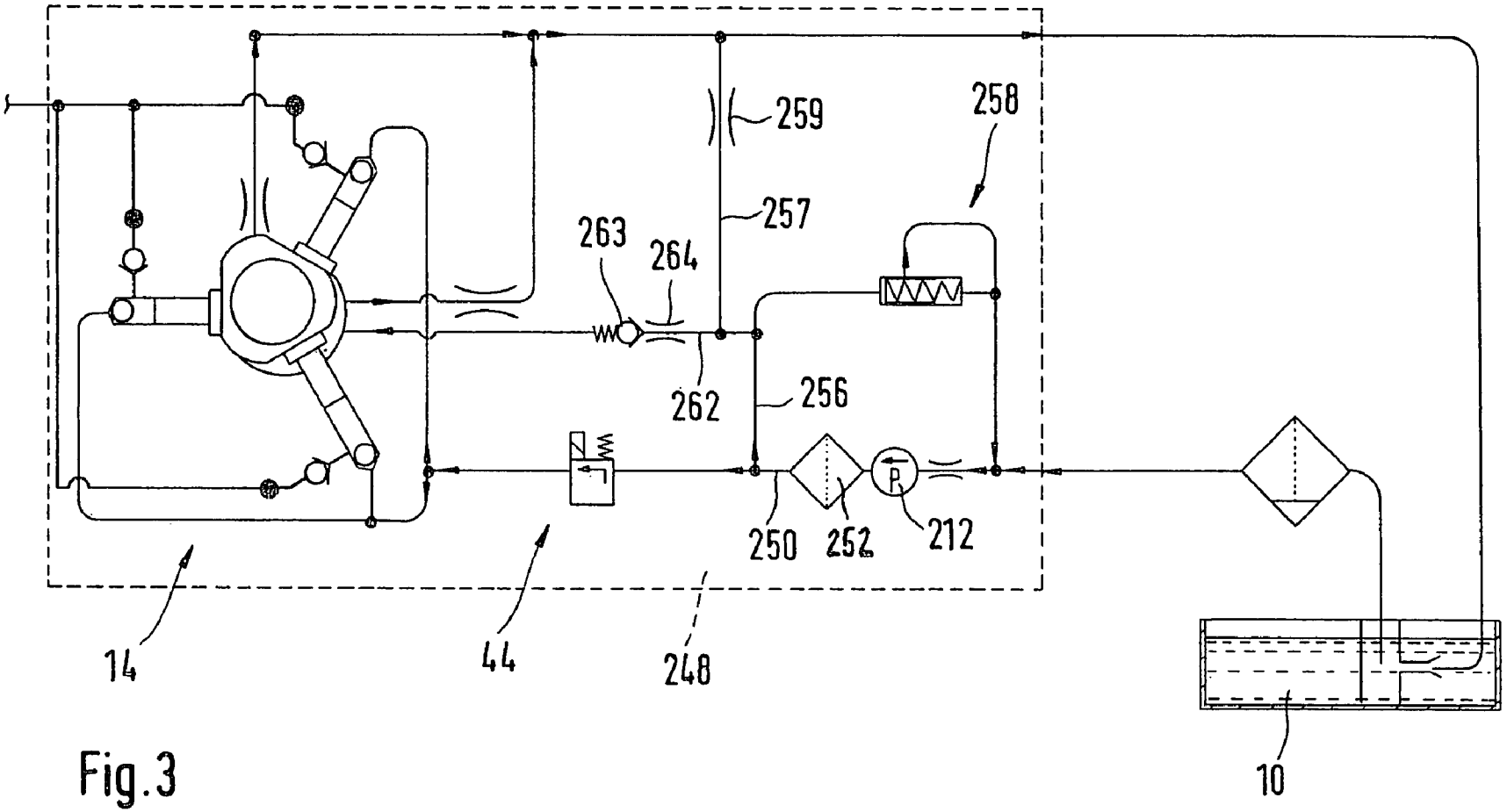
FIG. 3 shows a detail of the fuel injection system in a third exemplary embodiment.

In FIG. 3, the fuel injection system is shown in a third exemplary embodiment, which differs from the first and second exemplary embodiments only in that instead of the feed pump 12 with an electric motor drive, a mechanically driven feed pump 212 is provided. The feed pump 212 can be disposed directly on the high-pressure pump 14 and can be driven by the same shaft as the high-pressure pump 14. The inflow of fuel from the feed pump 212 to the fuel metering device 44 is effected, as in the first and second exemplary embodiments, through a bore 250 in a housing part 248 of the high-pressure pump 14. The bypass connection 256, which is controlled by the pressure valve 258, can branch off from the bore 250, and the lubrication connection 262 can branch off from the bypass connection 256 to the drive region of the high-pressure pump 14. Besides the throttle restriction 264, a pressure valve 263 can also be disposed in the lubrication connection 262; this pressure valve does not uncover the lubrication connection 262 until a predetermined pressure is exceeded. The pressure valve 263 can also be provided in the first or second exemplary embodiment. Downstream of the feed pump 212 and upstream of the branching point of the bypass connection 256, a fuel filter 252 is inserted into the bore 250; it is embodied in the same way as described above. The bypass connection 256 leads to the intake side of the feed pump 212, as a relief region. From the bypass connection 256, a connection 257, in which a throttle restriction 259 is disposed, leads away to the return 24. The connection 257 enables venting between the feed pump 212 and the fuel metering device 44, and the flow through the connection 257 is limited by the throttle restriction 259. The feed pump 212 can be preceded by a throttle restriction, in order to limit the flow to the feed pump 212. Instead of one common fuel filter 252 as shown in FIG. 3, a fuel filter 260 can also be disposed upstream of the fuel metering device 44 analogously to FIG. 1 and/or in the bypass connection 256 upstream of the pressure valve 258.

The foregoing relates to preferred exemplary embodiment of the invention, it being understood that other variants and embodiments thereof are possible within the spirit and scope of the invention, the latter being defined by the appended claims.

The invention claimed is:

1. A fuel injection system for an internal combustion engine, comprising a housing;

a high-pressure pump (14) supported by the housing, by which pump (14) fuel is pumped at high pressure into a reservoir (16);

a feed pump (12; 212), by which fuel is pumped from a fuel tank (18) to the high-pressure pump (14);

a fuel metering device (44), disposed between the feed pump (12; 212) and the high-pressure pump (14), by which the inflow of fuel to the high-pressure pump (14) is adjusted;

a bypass connection (56: 256), leading away from the connection between the feed pump (12; 212) and the fuel metering device (44), to a relief region, at least one conduit (50; 150; 250) in a part (48; 248) of the pump housing providing fuel inflow from the feed pump (12; 212) to the fuel metering device (44) and/or to the bypass connection (56; 256) and at least one fuel filter (52, 60; 152; 252) disposed in the at least one conduit (50; 150; 250) upstream of the fuel metering device (44) and/or of the bypass connection (56; 256).

2. A fuel injection system for an internal combustion engine, comprising a housing;

a high-pressure pump (14) supported by the housing, by which pump (14) fuel is pumped at high pressure into a reservoir (16);

a feed pump (12; 212), by which fuel is pumped from a fuel tank (18) to the high-pressure pump (14);

a fuel metering device (44), disposed between the feed pump (12; 212) and the high-pressure pump (14), by which the inflow of fuel to the high-pressure pump (14) is adjusted;

a bypass connection (56; 256), leading away from the connection between the feed pump (12; 212) and the fuel metering device (44), to a relief region, at least one conduit (50; 150; 250) in a part (48; 248) of the pump housing providing fuel inflow from the feed pump (12; 212) to the fuel metering device (44) and/or to the bypass connection (56; 256) and at least one fuel filter (52, 60; 152; 252) disposed in the at least one conduit (50; 150; 250) upstream of the fuel metering device (44) and/or of the bypass connection (56; 256), wherein said at least one fuel filter (52, 60; 152; 252) is embodied as a rod filter inserted into the conduit (50; 150; 250).

3. The fuel injection system of claim 1, wherein said at least one fuel filter (52, 60; 152; 252) is embodied as a screen filter.

4. The fuel injection system of claim 2, comprising at least two conduits (50; 150; 250) in a part (48; 248) of the pump housing, one of said at least two conduits providing fuel inflow from the feed pump (12; 212) to the fuel metering device (44) and another of said at least two conduits providing fuel inflow from the feed pump (12; 212) to the bypass connection (56; 256); and at least two fuel filters (52, 60; 152; 252), one of said at least two fuel filters being disposed in said one of said at least two conduits and the another of said at least two fuel filters being disposed in said another of said at least two conduits, wherein at least one of said fuel filters (52, 60; 152; 252) is embodied as a screen filter.

5. A fuel injection system for an internal combustion engine, comprising a housing;

a high-pressure pump (14) supported by the housing, by which pump (14) fuel is pumped at high pressure into a reservoir (16);

a feed pump (12; 212), by which fuel is pumped from a fuel tank (18) to the high-pressure pump (14);

a fuel metering device (44), disposed between the feed pump (12; 212) and the high-pressure pump (14), by which the inflow of fuel to the high-pressure pump (14) is adjusted;

a bypass connection (56; 256), leading away from the connection between the feed pump (12; 212) and the fuel metering device (44), to a relief region, at least one conduit (50; 150; 250) in a part (48; 248) of the pump housing providing fuel inflow from the feed pump (12; 212) to the fuel metering device (44) and/or to the bypass connection (56; 256) and at least one fuel filter (52, 60; 152; 252) disposed in the at least one conduit (50; 150; 250) upstream of the fuel metering device (44) and/or of the bypass connection (56; 256), further comprising a conduit (150) downstream of the fuel filter (152) and branching off to the fuel metering device (44) and to the bypass connection (56), at least one said fuel filter being disposed in the conduit (150).

6. The fuel injection system of claim 2, further comprising a conduit (150) downstream of the fuel filter (152) and branching off to the fuel metering device (44) and to the bypass connection (56), at least one said fuel filter being disposed in the conduit (150).

7. A fuel injection system for an internal combustion engine, comprising a housing;

a high-pressure pump (14) supported by the housing, by which pump (14) fuel is pumped at high pressure into a reservoir (16);

a feed pump (12; 212), by which fuel is pumped from a fuel tank (18) to the high-pressure pump (14);

a fuel metering device (44), disposed between the feed pump (12; 212) and the high-pressure pump (14), by which the inflow of fuel to the high-pressure pump (14) is adjusted;

a bypass connection (56; 256), leading away from the connection between the feed pump (12; 212) and the fuel metering device (44), to a relief region, at least one conduit (50; 150; 250) in a part (48; 248) of the pump housing providing fuel inflow from the feed pump (12; 212) to the fuel metering device (44) and/or to the bypass connection (56; 256) and at least one fuel filter (52, 60; 152; 252) disposed in the at least one conduit (50; 150; 250) upstream of the fuel metering device (44) and/or of the bypass connection (56; 256), wherein said at least one fuel filter (52, 60; 152; 252) is embodied as a screen filter, further comprising a conduit (150) downstream of the fuel filter (152) and branching off to the fuel metering device (44) and to the bypass connection (56), at least one said fuel filter being disposed in the conduit (150).

8. A fuel injection system for an internal combustion engine, comprising a housing;

a high-pressure pump (14) supported by the housing, by which pump (14) fuel is pumped at high pressure into a reservoir (16);

a feed pump (12; 212), by which fuel is pumped from a fuel tank (18) to the high-pressure pump (14);

a fuel metering device (44), disposed between the feed pump (12; 212) and the high-pressure pump (14), by which the inflow of fuel to the high-pressure pump (14) is adjusted;

a bypass connection (56; 256), leading away from the connection between the feed pump (12; 212) and the fuel metering device (44), to a relief region, at least one conduit (50; 150; 250) in a part (48; 248) of the pump housing providing fuel inflow from the feed pump (12; 212) to the fuel metering device (44) and/or to the bypass connection (56; 256) and at least one fuel filter (52, 60; 152; 252) disposed in the at least one conduit (50; 150; 250) upstream of the fuel metering device (44) and/or of the bypass connection (56; 256), further comprising a lubrication connection (62; 262) branching off from the bypass connection (56; 256) to a drive region (32) of the high-pressure pump (14); and a pressure relief valve (58; 258) in the bypass connection, with at least one of said at least one fuel filters (60; 152; 252) being disposed between the branching point of the lubrication connection (62; 262) and the pressure relief valve (58; 258).

9. The fuel injection system of claim 2, further comprising a lubrication connection (62; 262) branching off from the bypass connection (56; 256) to a drive region (32) of the high-pressure pump (14); and a pressure relief valve (58; 258) in the bypass connection, with at least one of said at least one fuel filters (60; 152; 252) being disposed between the branching point of the lubrication connection (62; 262) and the pressure relief valve (58; 258).

10. A fuel injection system for an internal combustion engine, comprising a housing;

a high-pressure pump (14) supported by the housing, by which pump (14) fuel is pumped at high pressure into a reservoir (16);

a feed pump (12; 212), by which fuel is pumped from a fuel tank (18) to the high-pressure pump (14);

a fuel metering device (44), disposed between the feed pump (12; 212) and the high-pressure pump (14), by which the inflow of fuel to the high-pressure pump (14) is adjusted;

a bypass connection (56; 256), leading away from the connection between the feed pump (12; 212) and the fuel metering device (44), to a relief region, at least one conduit (50; 150; 250) in a part (48; 248) of the pump housing providing fuel inflow from the feed pump (12; 212) to the fuel metering device (44) and/or to the bypass connection (56; 256) and at least one fuel filter (52, 60; 152; 252) disposed in the at least one conduit (50; 150; 250) upstream of the fuel metering device (44) and/or of the bypass connection (56; 256), wherein said at least one fuel filter (52, 60; 152; 252) is embodied as a screen filter, further comprising a lubrication connection (62; 262) branching off from the bypass connection (56; 256) to a drive region (32) of the high-pressure pump (14); and a pressure relief valve (58; 258) in the bypass connection, with at least one of said at least one fuel filters (60; 152; 252) being disposed between the branching point of the lubrication connection (62; 262) and the pressure relief valve (58; 258).

11. The fuel injection system of claim 5, further comprising a lubrication connection (62; 262) branching off from the bypass connection (56; 256) to a drive region (32) of the high-pressure pump (14); and a pressure relief valve (58; 258) in the bypass connection, with at least one of said at least one fuel filters (60; 152; 252) being disposed between the branching point of the lubrication connection (62; 262) and the pressure relief valve (58; 258).

12. The fuel injection system of claim 1, wherein the housing part (48; 248) is a housing part of the high-pressure pump (14).

13. The fuel injection system of claim 12, wherein the housing part of the high-pressure pump (14) is a cap part of the high-pressure pump (14).

* * * * *